US006827052B2

(12) United States Patent
Kobayashi et al.

(10) Patent No.: US 6,827,052 B2
(45) Date of Patent: Dec. 7, 2004

(54) VARIABLE VALVE TIMING DEVICE

(75) Inventors: Masaki Kobayashi, Toyota (JP); Katsuhiko Eguchi, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/400,791

(22) Filed: Mar. 28, 2003

(65) Prior Publication Data

US 2003/0221647 A1 Dec. 4, 2003

(30) Foreign Application Priority Data

Mar. 28, 2002 (JP) ..... 2002-090250

(51) Int. Cl.[7] ..... F01L 1/34

(52) U.S. Cl. ..... 123/90.17; 123/90.16; 123/90.31; 92/122; 464/160

(58) Field of Search ..... 123/90.15–90.18, 123/90.27, 90.31; 92/120–126; 464/1, 2, 160

(56) References Cited

U.S. PATENT DOCUMENTS 5,775,279 A * 7/1998 Ogawa et al. ..... 123/90.17
5,836,277 A * 11/1998 Kira et al. ..... 123/90.17
2002/0062802 A1 * 5/2002 Saito et al. ..... 123/90.17

FOREIGN PATENT DOCUMENTS

JP 2001-355468 A 12/2001

* cited by examiner

*Primary Examiner*—Thomas Denion
*Assistant Examiner*—Kyle M. Riddle
(74) *Attorney, Agent, or Firm*—Burns, Doane, Swecker & Mathis, L.L.P.

(57) ABSTRACT

A variable valve timing control device includes a rotation member unitary fixed to a rotation shaft for controlling a valve timing assembled to a cylinder head of an internal combustion engine to be rotatable, a rotation transmission member engaged with the rotation member to be relatively rotatable, a vane provided on either one of the rotation member or the rotation transmission member, a hydraulic pressure chamber formed between the rotation member and the rotation transmission member and is divided into an advance angle chamber and a retarded angle chamber by the vane, and a detection member for detecting a relative rotation phase between the rotation member and a crankshaft. The detection member is press fitted into a cylindrical portion formed in an axial direction of the rotation member and the rotation member is fixed to the rotation member by a tightening member.

4 Claims, 2 Drawing Sheets

VARIABLE VALVE TIMING DEVICE

This application is based on and claims priority under 35 U.S.C. §119 with respect to Japanese Patent Application No. 2002-090250 filed on Mar. 28, 2002, the entire content of which is incorporated herein by reference.

FIELD OF THE INVENTION

The present invention generally relates to a variable valve timing control device. More particularly, the present invention pertains to a variable valve timing control device for controlling a valve timing of intake and exhaust valves for an internal combustion engine.

BACKGROUND OF THE INVENTION

A known variable valve timing control device is disclosed in Japanese Patent Laid-Open Publication No. 2001-355468. The variable valve timing control device disclosed in Japanese Patent Laid-Open Publication No. 2001-355468 includes a rotation member unitary fixed to a rotation shaft for opening and closing valve rotatably assembled to a cylinder head of the internal combustion engine, a rotation transmission member engaged to the rotation member to be relatively rotatable, vanes provide on either one of the rotation member or the rotation transmission member, hydraulic pressure chambers formed between the rotation member and the rotation transmission member and divided into an advance angle chamber and a retarded angle chamber by the vane, and a detection member for detecting a relative rotation phase between the rotation member and a crankshaft.

With the foregoing known variable valve timing control device, the detection member is fitted into a cylindrical concave portion formed on the rotation member and is sandwiched between a rotation shaft and a tightening member by a screw connection of the tightening member and the rotation shaft. The detection member is formed by any one of unitary stamping and cutting, sintering unitary molding and cutting, or coupling of two parts.

Notwithstanding, with the known detection member, it is required to increase the precision of a fitting portion and a tightening seat surface, and thus the manufacturing cost is increased by for example, cutting. In addition, because the tightening force of the tightening member is received by the tightening seat surface, it is required to apply the material with high critical surface pressure or it is required to apply the heat treatment, the manufacturing cost is increased. In order to avoid the rotation of the detection member along with the rotation of the tightening member when tightening, the assembling becomes complex for preventing the rotation of the rotation member by an assembling jig or a rotation prevention mechanism.

A need thus exists for a variable valve timing control device which fixes a detection member for detecting a relative rotation phase between a rotation member and a crankshaft with low cost and simple construction.

SUMMARY OF THE INVENTION

In light of the foregoing, the present invention a variable valve timing control device which includes a rotation member unitarily fixed to a rotation shaft for opening and closing a valve assembled to a cylinder head of an internal combustion engine to be rotatable, a rotation transmission member engaged with the rotation member to be relatively rotatable, a vane provided on the rotation member or the rotation transmission member, a hydraulic pressure chamber formed between the rotation member and the rotation transmission member and divided into an advance angle chamber and a retarded angle chamber by the vane, and a detection member for detecting a relative rotation phase between the rotation member and a crankshaft. The detection member is press fitted into a cylindrical portion formed in an axial direction of the rotation member and the rotation member is fixed to the rotation member by a tightening member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
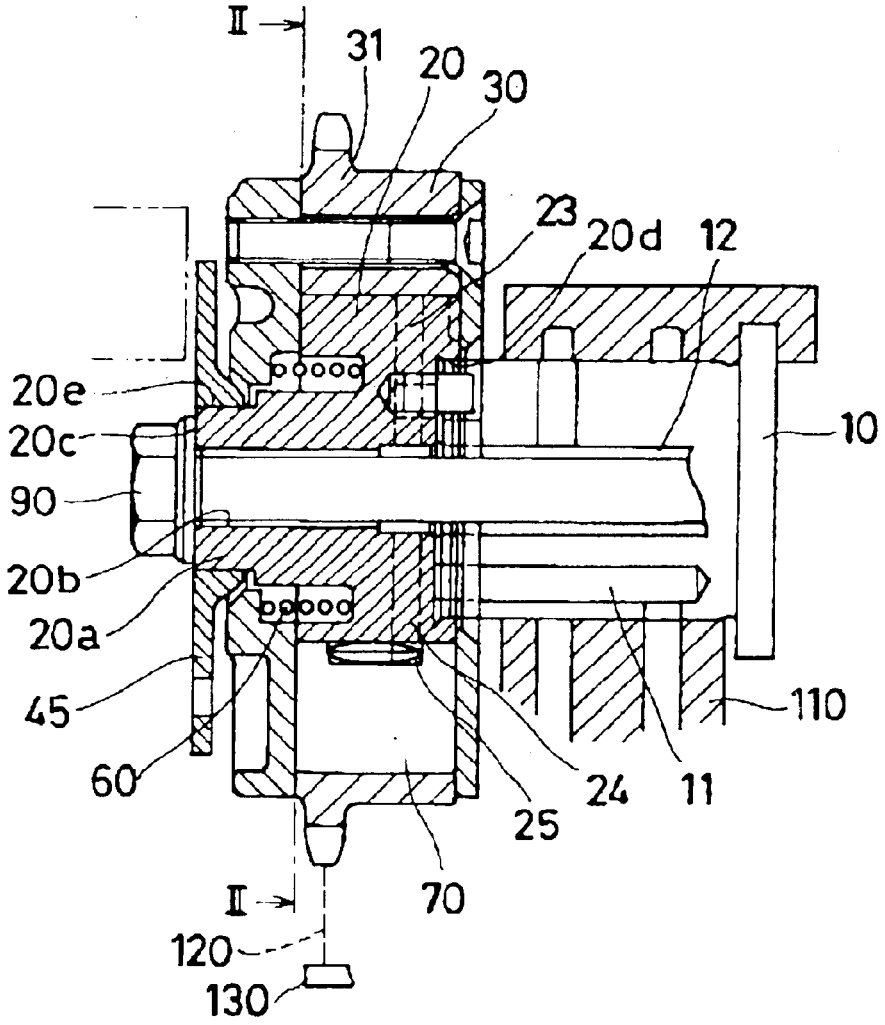
FIG. 1 is a cross-sectional view of a variable valve timing control device according to an embodiment of the present invention.

One embodiment of a variable valve timing control device will be explained with reference to the illustrations of the drawing figures.

Figure 2:
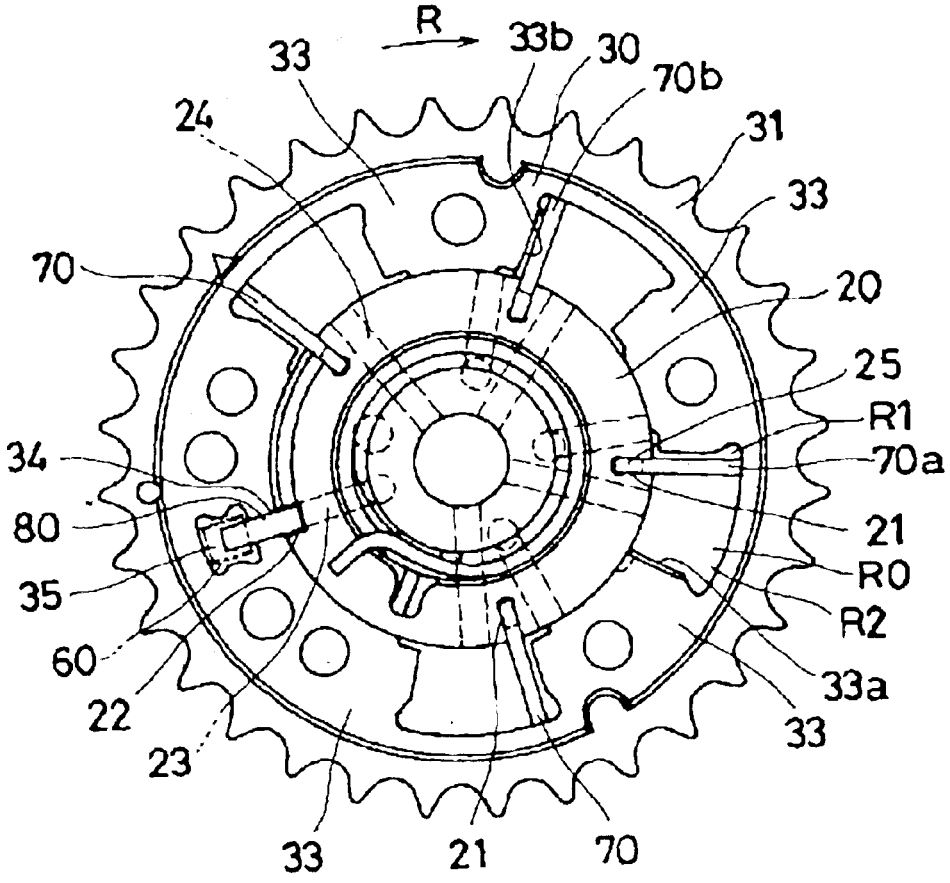
FIG. 2 is a cross-sectional view taken on line II—II of FIG. 1 of the variable valve timing control device according to the embodiment of the present invention.

As shown in FIGS. 1–2, the variable valve timing control device includes a rotor 20 (i.e., serving as a rotation member) unitary assembled to a tip end portion of a camshaft 10 (i.e., serving as a rotation shaft) rotatably supported by a cylinder head 110 of an internal combustion engine, a housing 30 (i.e., serving as a rotation transmission member) is assembled to an external periphery of the rotor 20 to be relatively rotatable within a predetermined angle. A timing sprocket 31 is unitary formed on an external periphery of the housing 30, and four vanes 70 assembled to the rotor 20. The timing sprocket 31 is transmitted with rotational force from a crankshaft 130 via a crank sprocket (not shown) and a timing chain 120. Although the rotation of the crankshaft 130 of the internal combustion engine is transmitted to the timing sprocket 31 of the housing 30 via the timing chain 120 with this embodiment, the construction is not limited to this embodiment. For example, a belt member may be applied in place of the timing chain and the timing sprocket 31 may be replaced by a pulley.

The rotor 20 having a stepped cylindrical configuration at a center thereof is formed with a cylindrical portion 20*a* and a penetration bore 20*b* in an axial direction. The rotor 20 includes a recess portion 20*d* on an end surface to which the camshaft 10 is positioned to be assembled. A single assembling bolt 90 penetrated through the penetration bore 20*b* contacts a seat surface 20*c* formed on an end portion of the cylindrical portion 20*a* to be tightened to the camshaft 10 for fixing the rotor 20. Approximately disc shaped sensor wheel 45 is press fitted to be fixed on an external periphery 20*e* of the cylindrical portion 20*a*. When the rotor 20 is fixed to the camshaft 10 via the assembling bolt 90, the external periphery 20*e* of the cylindrical portion 20*a* is slightly deformed in radial direction by the axial tension of the assembling bolt 90, the tension between the cylindrical portion 20*a* and the sensor wheel 45 is increased, and the deviation of the sensor wheel 45 relative to the rotor 20 by the impact torque received from the camshaft 10 is eradicated. Although the bolt seat surface 20*c* has the same height with the sensor wheel 45 according to FIG. 1, the height of the bolt seat surface 20*c* is not limited to this height. Four advance angle passages 23 and four retarded angle passages 24 extend in the radial direction, four vane grooves 21 and a receiving groove 22 are provided outwardly on the rotor 20. Four vanes 70 are provided in respective vane grooves 21 to be radially movable. A leaf spring 25 is provided between a bottom of the vane groove 21 and a bottom surface of the vane 70. Thus, the vanes 70 are outwardly biased to slide on a sliding surface of the housing 30. The receiving groove 22 is provided with a lock key 80 which head portion is inserted in the receiving groove 22 by a predetermined amount when a relative position of the camshaft 10 and the rotor 20 and the housing 30 is synchronized at a predetermined phase (i.e., most retarded angle position) as shown in FIG. 2. The receiving groove 22 is in communication with the advance angle passages 23.

The housing 30 is assembled to an external periphery of the rotor 20 to be relatively rotatable within a predetermined angle. The timing sprocket 31 is unitary formed on the external periphery of the housing 30.

Four convex portions 33 are formed on an internal periphery of the housing 30 in the peripheral direction. The internal peripheral surface of the convex portions 33 contacts an external peripheral surface of the rotor 20 so that the housing 30 is rotatably supported by the rotor 20. One of the convex portions 33 is formed with a retraction groove 34 for accommodating the lock key 80 and an accommodation groove 35 for a spring 60 biasing the lock key 80 in the radially inward direction.

The vane 70 divides a hydraulic pressure chamber R0 formed between adjacent convex portions 33 in peripheral direction and between the housing 30 and the rotor 20 into an advance angle chamber R1 and a retarded angle chamber R2. The relative rotation of a vane 70*a* is restricted at a position contacting one side surface 33*a* of the convex portion 33 in the periphery direction on the most advance angle side. The relative rotation of the vane 70*a* is restricted at a position contacting the other side surface 33*b* of the convex portion 33 in the periphery direction on the most retarded angle side. The relative rotation between the rotor 20 and the housing 30 is restricted by inserting the head portion of the lock key 80 into the receiving groove 22 on the retarded angle side.

The operation of the variable valve timing control device of the embodiment with the foregoing construction will be explained as follows.

The variable valve timing control device obtains a desired valve timing by controlling the relative rotation of the rotor 20 relative to the housing 30 by adjusting the hydraulic pressure in the advance angle chamber R1 and the retarded angle chamber R2. In this case, it is judged whether the desired valve timing is obtained by comparing a rotation phase detected by a sensor (not shown) from the sensor wheel 45 unitary rotated with the rotor 20 and a rotation phase detected by a sensor (not shown) provided on a crankshaft portion.

When the internal combustion engine is stopped, the head portion of the lock key 80 is inserted into the receiving groove 22 of the rotor 20 by a predetermined amount to lock the relative rotation between the rotor 20 and the housing 30 at the most retarded angle position.

When the advance angle is required for a valve timing in accordance with the operation conditions after starting the internal combustion engine, the operation fluid supplied from an oil pump (not shown) by the operation of a switching valve (not shown) is applied to the advance angle chamber RI via the advance angle passages 23. The operation fluid is supplied to the receiving groove 22 from the advance angle passage 23. On the other hand, the operation fluid in the retarded angle chamber R2 is discharged to an oil pan (not shown) from the switching valve via the retarded angle side passages 24. In this case, the lock key 80 moves against the biasing force of the spring 60 and the head portion of the lock key 80 is removed from the receiving groove 22 to release the lock between the rotor 20 and the housing 30. Accordingly, the rotor 20 and the vanes 70 unitary rotated with the camshaft 10 rotates towards the advance angle side R relative to the housing 30.

When the retarded angle is required for the valve timing in accordance with the operation conditions, the operation fluid supplied from the oil pump is supplied to the retarded angle chamber R2 via the retarded angle passage 24 by the operation of the switching valve. On the other hand, the operation fluid in the advance angle chamber R1 is discharged to the oil pan from the switching valve via the advance angle passage 23. Thus, the rotor 20 and the vanes 70 are rotated towards the retarded angle side relative to the housing 30.

According to the embodiment of the present invention, because the tightening force from the seat surface of the assembling bolt is received by the rotor, high critical surface pressure of the sensor wheel 45 is not required. Thus, the inexpensive material can be applied. In addition, because such materials have favorable formability, the unitary stamping can be performed and cutting is not required. Further, because the rotation by the tightening force from the seat surface of the assembling bolt is received by the rotor, the rotation of the sensor wheel 45 following the rotation of the tightening member can be eradicated and the assembling jig and the rotation prevention mechanism for preventing following rotation are not required.

According to the embodiment of the present invention, the axial tension of the assembling bolt is applied to the rotor in the axial direction to slightly expand the rotor in the radial direction and thus the tension between the external periphery of the cylindrical portion and the sensor wheel can be improved. In case simply the dimension of press fitting portion is increased by adjusting the dimension of the rotor and the sensor wheel, the drawback that the sensor is not enabled to be press fitted perpendicularly due to the scratching is caused. With the embodiment of the present invention, the tension can be increased by further increasing the dimension of press fitting portion by the slight expansion of the rotor by the axial force of the assembling bolt after press fitting with the dimension of press fitting portion which achieves appropriate press fitting. Thus, the deviation of the sensor wheel relative to the rotor by the impact torque received from the camshaft can be eradicated at the engine operation.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing control device comprising:

a rotation member unitarily fixed to a rotation shaft for controlling a valve timing assembled to a cylinder head of an internal combustion engine to be rotatable;

a rotation transmission member engaged with the rotation member to be relatively rotatable;

a vane provided on either the rotation member or the rotation transmission member;

a hydraulic pressure chamber formed between the rotation member and the rotation transmission member, the hydraulic pressure chamber being divided into an advance angle chamber and a retarded angle chamber by the vane;

a detection member for detecting a relative rotation phase between the rotation member and a crankshaft;

the detection member being press fitted to an external periphery of a cylindrical portion formed in an axial direction of the rotation member, and the rotation member being fixed to the rotation shaft by a tightening member; and wherein the external periphery of the cylindrical portion is deformed in a radial direction by axial force of the tightening member.

2. A variable valve timing control device comprising:

a rotation member unitarily fixed to a rotation shaft by a tightening member for controlling a valve timing assembled to a cylinder head of an internal combustion engine to be rotatable;

a rotation transmission member engaged with the rotation member to be relatively rotatable;

a vane provided on either the rotation member or the rotation transmission member;

a hydraulic pressure chamber formed between the rotation member and the rotation transmission member, the hydraulic pressure chamber being divided into an advance angle chamber and a retarded angle chamber by the vane;

a detection member for detecting a relative rotation phase between the rotation member and a crankshaft;

the detection member being press fitted to an axially extending cylindrical portion of the rotation member at a position between where an end portion of the cylindrical portion contacts the rotation shaft and where an oppositely located end portion of the cylindrical portion contacts the tightening member.

3. A variable valve timing control device comprising:

a rotation member unitarily fixed by a bolt to a rotation shaft assembled to a cylinder head of an internal combustion engine to be rotatable;

the bolt contacting an axially facing surface at an end portion of the rotation member;

a rotation transmission member engaged with the rotation member to be relatively rotatable;

a vane provided on either the rotation member or the rotation transmission member;

a hydraulic pressure chamber formed between the rotation member and the rotation transmission member, the hydraulic pressure chamber being divided into an advance angle chamber and a retarded angle chamber by the vane;

a sensor wheel adapted to detect a relative rotation phase between the rotation member and a crankshaft;

the sensor wheel being mounted on the end portion of the rotation member at a position where axial tension of the bolt resulting from tightening the bolt to the rotation shaft produces radial expansion of the rotation member which acts on the sensor wheel.

4. The variable valve timing control device according to claim 3, wherein the sensor wheel is press fitted onto an outer periphery of the rotation member before the bolt is tightened to produce the radial expansion of the rotation member.

* * * * *